United States Patent [19]

Bührer BEST AVAILABLE COPY

[11] 3,997,088

[45] Dec. 14, 1976

[54] JET DEFLECTING AND ENERGY DISSIPATING POURING DEVICE

[76] Inventor: Erwin Bührer, Vogelingasschen 40, 8200 Schaffhausen, Switzerland

[22] Filed: Dec. 4, 1974

[21] Appl. No.: 529,479

Related U.S. Application Data

[63] Continuation-in-part of Ser. No. 405,630, Oct. 11, 1973, abandoned, which is a continuation of Ser. No. 245,823, April 20, 1972, abandoned.

[30] Foreign Application Priority Data

Apr. 21, 1971 Switzerland ..... 5827/71

[52] U.S. Cl. ..... 222/461; 164/337; 222/564

[51] Int. Cl.[2] ..... B22D 37/00

[58] Field of Search ..... 164/335, 337; 222/164, 222/166, 461, 547, 564; 249/108

[56] References Cited

UNITED STATES PATENTS

| | | | |
|---|---|---|---|
| 1,726,581 | 9/1929 | Orbin | 222/460 UX |
| 2,049,148 | 7/1936 | Arness | 249/108 X |
| 2,345,493 | 3/1944 | Mueller | 249/108 X |
| 2,772,455 | 12/1956 | Easton et al. | 164/281 X |
| 3,228,072 | 1/1966 | Hazelett et al. | 164/281 X |
| 3,456,713 | 7/1969 | Michelson | 164/281 X |
| 3,517,725 | 6/1970 | Watts | 164/281 X |

*Primary Examiner*—Robert B. Reeves
*Assistant Examiner*—David A. Scherbel
*Attorney, Agent, or Firm*—Toren, McGeady and Stanger

[57] ABSTRACT

For pouring molten metal, a device is provided which affords a flow passage between a source of supply of the molten metal and a mold. The device is supported separately from the mold and can be rotated about a vertical axis and tilted about a horizontal axis. A jet deflecting member is provided in the flow passage to provide a kinetic energy dissipating effect and the passage is arranged to afford automatic emptying of the molten metal from the device. Various embodiments of the flow passage include walls forming a tortuous flow path or a weir-shaped wall between the inlet and the outlet of the device. Additionally, a downwardly inclined elongated nozzle forms the flow passage outlet from the device with the outlet offset relative to the inlet to the device.

10 Claims, 11 Drawing Figures

JET DEFLECTING AND ENERGY DISSIPATING POURING DEVICE

This is a continuation-in-part of application Ser. No. 405,630 filed Oct. 11, 1973, which application was a continuation of application Ser. No. 245,823 filed Apr. 20, 1972, both now abandoned.

SUMMARY OF THE INVENTION

The present invention is directed to a device for pouring liquid metal into a mold and, more particularly, it concerns a device supported separately from the mold and arranged to afford a jet deflecting effect to molten metal passing through it into the mold.

It has been known to form flow passages with jet deflecting means in the upper part of a mold or to attach such means on the mold. These flow passages are designed as casting basins with either an overflow or a deflection member.

Developments in the foundry field have led to automatic plants using increasingly larger molds. As the size of the molds has increased, the amount of liquid metal to be poured per unit of time has correspondingly increased. Further, there is the tendency in the foundry field to employ lower casting temperatures and higher casting velocities. This is especially true for black heart malleable iron and for spheroidal cast iron. Due to the large amounts of molten metal to be poured per unit of time, correspondingly large dimensions are involved in the pouring devices which are secured to the molds.

In the use of a casting basin with an overflow there is the disadvantage that a portion of the metal remains in the casting basin after the completion of the filling of the mold and such a residue tends to impair the yield in the pouring operation. When a deflecting member is used in the casting basin, while a quiescent flow is provided, the dimensions of the device are inadmissably large.

Where a funnel is formed as a part of or is attached to a mold it does not provide any quieting action on the casting jet nor is it likely to retain slag.

Therefore, the primary object of the present invention is to eliminate the disadvantages experienced in the known devices. The solution to the problems experienced in the past is to provide a device with a flow passage which is supported separately from the mold and can be automatically emptied. Such a device is intended primarily for use in automated casting installations where there has been a trend towards increasingly larger mold sizes. The device is particularly suitable for such installations, since it allows high rates of pouring of the melt with little, if any, turbulence in the melt and with low speed of entry of the melt into the molds. Because the device is located above each mold during the pouring operations, very high rates of pouring involve a high risk of splashing at the mold and the present invention limits the effect of such splashing.

In a preferred embodiment of the present invention the flow passage through the device which conducts the melt from the supply source to the mold is arranged to provide a kinetic energy dissipating effect and also to afford automatic emptying of the flow passage.

To assure the proper effect, the melt outlet from the device is located below and is offset laterally from the melt inlet. To afford automatic emptying of the molten metal, the melt outlet is provided from the lowermost portion of the flow passage through the device. In addition, the device is supported separately from the mold so that it can be tilted into a position for pouring into the mold where it is supported on top of the mold. Further, the device is supported so that it can be rotated about a vertical axis for emptying the melt into the mold or into a separate container located alongside the mold.

Another feature of the present invention is the casting method it provides in which a flow passage for transporting the melt from a supply source to the mold is movably displaceable relative to the mold and, further, it is arranged so that a kinetic energy dissipating effect is provided as the melt streams from the supply source to the mold. The kinetic energy dissipating effect is provided by laterally offsetting the melt outlet from the flow passage relative to the melt inlet. Therefore, by means of the present invention, it is possible to reduce to a great extent the risk of splashing of the melt at the mold particularly at very high pouring rates, because the device forming the melt flow passage from the supply source to the mold is placed in contact with the top of the mold during pouring.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
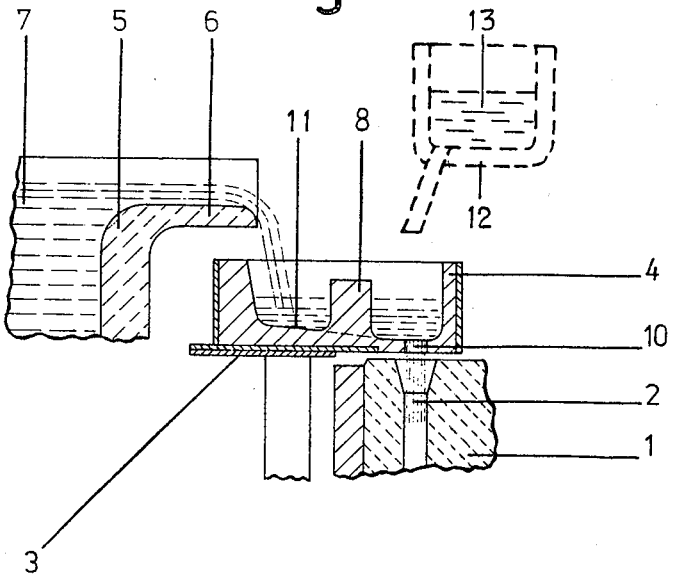
FIG. 1 is a cross-sectional view of a device, embodying the present invention, taken along line I—I in FIG. 2.
Figure 2:
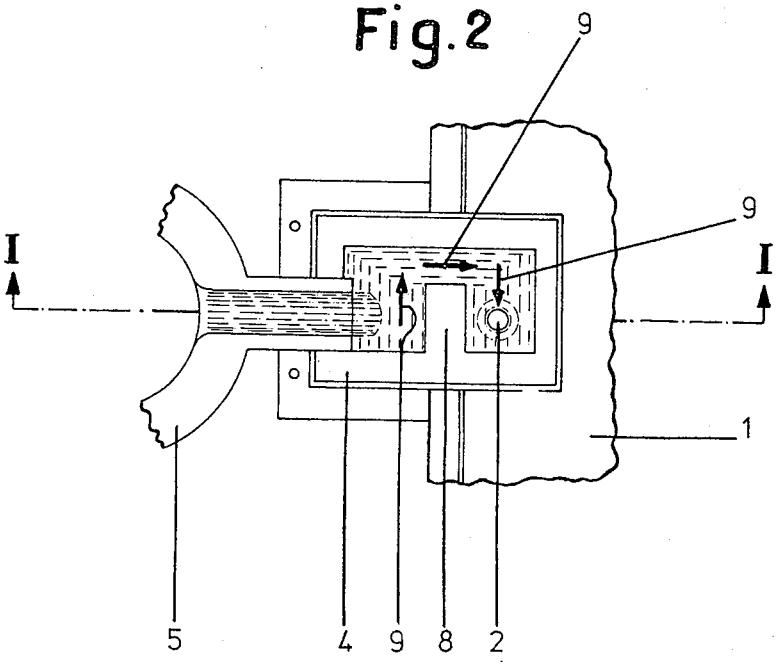
FIG. 2 is a plan view of the device shown in FIG. 1.

In FIGS. 1 and 2, a mold 1 is shown with an inlet or sprue 2. Located above the mold and supported separately from it by means of a support 3 is a pouring device 4 designed as a flowthrough member or casting basin with a deflection arrangement. Above the pouring device 4 is a tank or supply source of a molten metal 7 which flows from a spout 6. When the metal is poured into the device 4, it enters the upper inlet end of a flow passage formed by the flowthrough member and as the metal flows to the outlet 10, in the direction indicated by the arrows 9, it is deflected by a dam or baffle wall 8. Due to the arrangement of the baffle wall 8, in the flow passage through the device 4, the molten metal 7 effects a tortuous path flow from the point at which it enters the device from the supply source or tank 5 to the outlet 10 from where it flows into the mold 1 through its sprue 2. As can be seen in FIG. 1, the bottom 11 of the flow passage within the device 4 is inclined downwardly in the direction of the arrows so that the outlet 10 is located at the lowermost point in the flow passage whereby the metal empties automatically from the outlet 10 at the end of the casting process.

Figure 3:
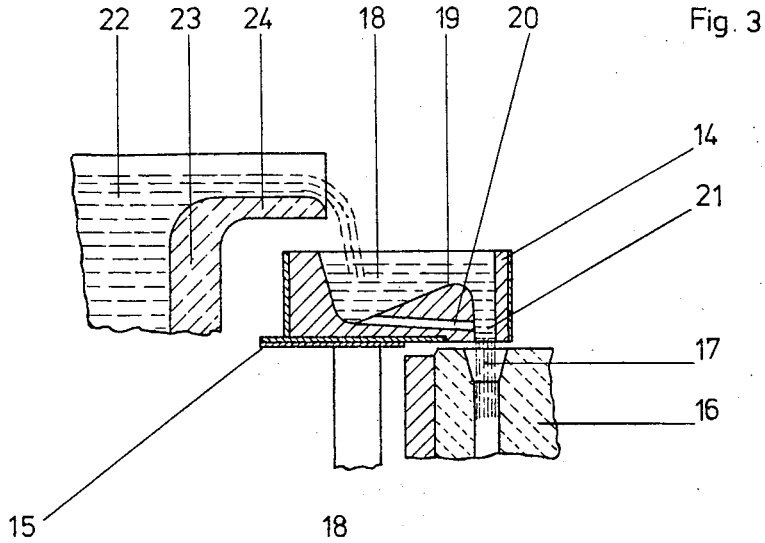
FIG. 3 is a cross-sectional view of another embodiment of the present invention taken along the line III—III of FIG. 4.
Figure 4:
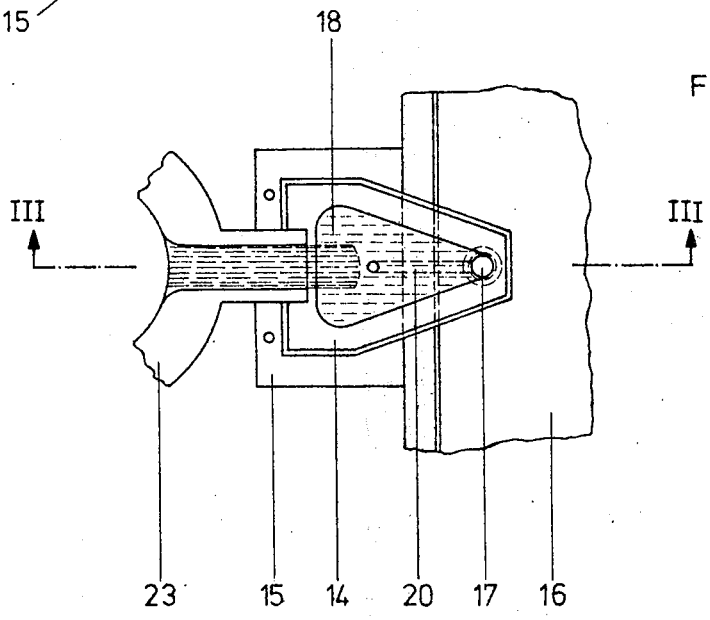
FIG. 4 is a plan view of the embodiment shown in FIG. 3.

In FIGS. 3 and 4, a pouring device 14 is illustrated which is similar to the one shown in FIGS. 1 and 2. The device rests on a support 15 which is separate from a mold 16 above which the device 14 is positioned. The outlet end 21 of the flow passage through the device 14 is located above the sprue or inlet 17 into the mold 16. The device 14 is formed as a flowthrough member or casting basin 18 with a weir-shaped wall or deflecting member 17 which provides an overflow between the inlet end and the outlet end of the device. As can be noted in FIG. 3, the bottom of the casting basin at its inlet end is located above the outlet 21 from the device 14 and as indicated above, the outlet is located at the lowermost point within the casting basin 18. This arrangement differs from known casting basins in that a by-pass outlet 20 slopes downwardly from the inlet part of the casting basin through the base of the weir-shaped wall 19 to a point adjacent the outlet 21 from the basin into the mold. With this arrangement an automatic discharge of all the metal deposited in the casting basin is assured. The molten metal 22 is discharged into the pouring device from a supply source or tank 23 through a spout 24.

Figure 5:
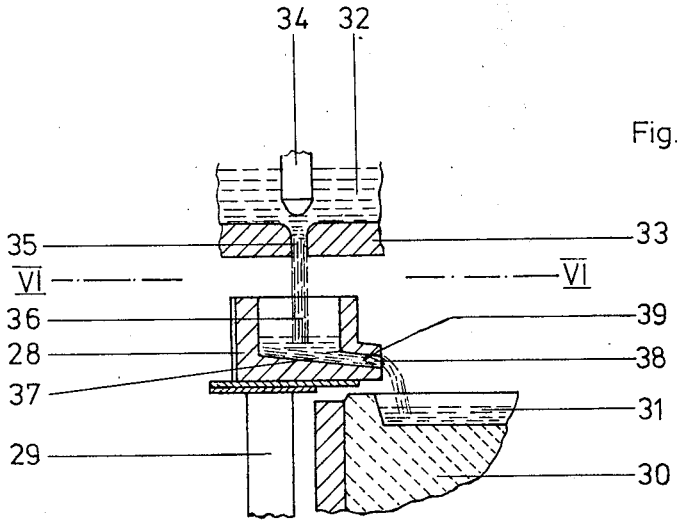
FIG. 5 is a cross-sectional view of still another embodiment of the present invention taken along the line V—V in FIG. 6.
Figure 6:
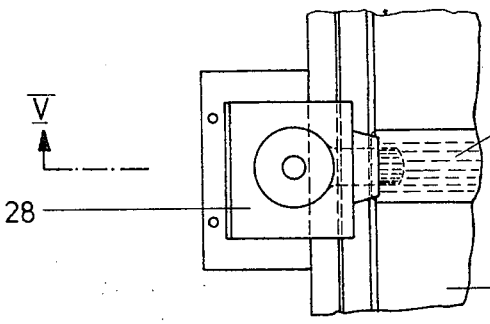
FIG. 6 is a plan view of the embodiment shown in FIG. 5.

In a third embodiment of the present invention, shown in FIGS. 5 and 6, a pouring device 28 is mounted on a support both of which are separate from a mold 30. An overflow inlet 31 is provided in a known manner for the mold 30. Molten metal is charged into the pouring device 28 from a reservoir or tank 33 passing through an opening 35 containing a stopper 34. As shown in FIG. 5, when the stopper 34 is withdrawn from the opening 35, the metal flows downwardly into the pouring device 28. The pouring device is shaped as a hollow upright body 36 closed at its lower surface 37 with the lower surface inclined downwardly toward an outlet channel 38 which is offset laterally from the axis of the inlet flow into the pouring device. As with the other casting basins or flowthrough members disclosed, the outlet is located at the lowermost part of the space containing the molten metal within the device. The outlet channel 39 continues the downward slope of the bottom surface 37 to the point at which it discharges the molten metal into the overflow 31 in the mold 30.

Figure 7:
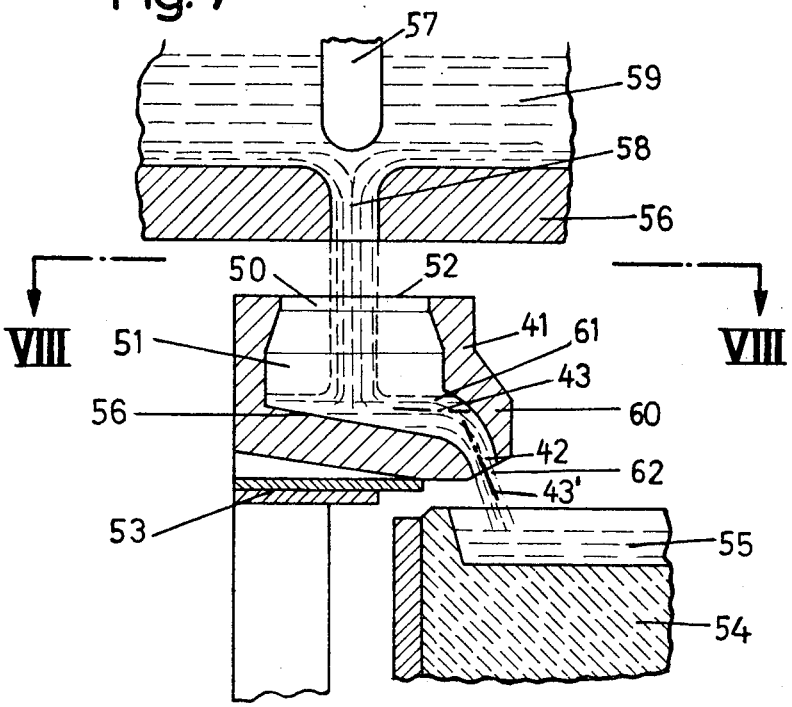
FIG. 7 is a cross-sectional view of yet another embodiment of the present invention taken along the line VII—VII in FIG. 8.
Figure 8:
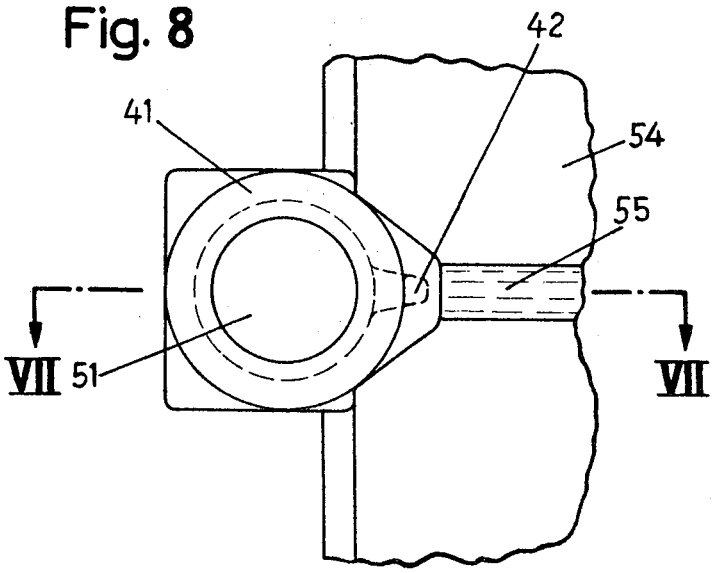
FIG. 8 is a top view of the device shown in FIG. 7 taken along the line VIII—VIII in FIG. 7.

In still another embodiment of the invention, shown in FIGS. 7 and 8, a pouring device 41 forms a flow passage between a source of supply or tank 56 and a mold 54. The pouring device 41 is mounted on a support 53 and both the device and the support are separate from the casting mold 54. Similar to the mold shown in FIGS. 5 and 6, the mold 54 has an overflow 55 located below the outlet end of an outlet passage or nozzle 42 formed in the lower part 60 of the pouring device 41. At its inlet end 61, the axis 43 of the outlet nozzle is substantially horizontal while its outlet end 62 the axis 43' is substantially vertical. As can be seen in FIG. 7, the outlet nozzle is offset laterally from the axis of the inlet into the pouring device 41. To prevent any spilling when the molten metal is charged to the chamber 51 within the pouring device 41, the cross-section of the inlet opening diverges in the downward direction from the rim 52 to the cylindrically shaped portion of the chamber 51. Above the pouring device is the tank 56 which has a stopper 57 for regulating the flow of metal through the outlet opening 58 into the inlet opening 50 in the pouring device. As in the embodiment shown in FIG. 5, in FIG. 7 the outlet nozzle 42 from the chamber is offset laterally from the inlet flow into the pouring device.

Figure 9:
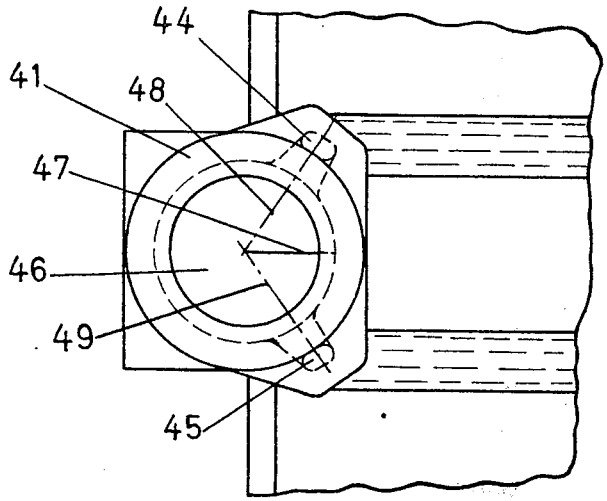
FIG. 9 is a top view similar to FIG. 8, showing an alternate embodiment of the device.

In FIG. 9 an alternate arrangement of the pouring device 41 is shown in which a pair of outlet nozzles 44, 45 are spaced angularly apart from one another. The bottom surface 46 within the pouring device 41 has ridge-like configuration 47, as in a roof construction, formed as an angular bisector of the angularly spaced outlet nozzles. Outlet nozzle 44 has an axis 48 and outlet nozzle 45 has an axis 49 and, as shown in FIG. 9, these axes intersect at the ridge 47. In this arrangement it is possible to provide the outlet nozzles 44, 45 with different outlet cross-sections.

According to the present invention, the pouring device has the advantage that the inlet velocity of the metal into the mold can be selected at a rate which is lower than has been possible in the past. As a result, the spilling which takes place during the pouring operation in the past can be avoided. Furthermore, the flow of metal into the mold is less turbulent. Accordingly, fewer oxides are formed as the metal flows into the mold. Similarly, erosion at the inlet to the mold is avoided.

The arrangement of the pouring device shown in FIGS. 5 and 6 affords the most advantageous arrangement of the various embodiments described above. In this particular embodiment, the metal can flow slag-free from a tank with a stopper into the device which has the shape of a hollow body. In this arrangement the flow of the metal jet is killed or quieted in a particularly effective manner and flows at a lower velocity from the outlet of the pouring device into the mold. As a result, the embodiment in FIGS. 5 and 6 is particularly suitable for pouring large amounts of metal per unit of time.

The advantages achievable with the embodiments shown in FIGS. 7 to 9 consist, in particular, in the manner in which the metal jet entering the casting basin of the pouring device can be determined by the arrangement and the design of the outlet nozzle from the device, independent of the height of the metal within the chamber in the device. Additionally, in this embodiment, it is possible to provide several nozzles from one pouring device each of which is associated with a different casting basin or overflow in the mold. Further, if the outlet nozzles from the pouring device have different cross-sections, varying amounts of the metal can be fed to the casting basins in the mold per unit of time.

In tests it has been shown that an addition of inoculants 13 during the pouring operation can be afforded where the jet of the metal enters the pouring device with an excellent seating effect. Therefore, as shown in FIG. 1, a receptacle 12 is provided above the pouring device 4 for feeding inoculants into the metal as it flows from the inlet to the outlet of the device or flowthrough member.

Figure 10:
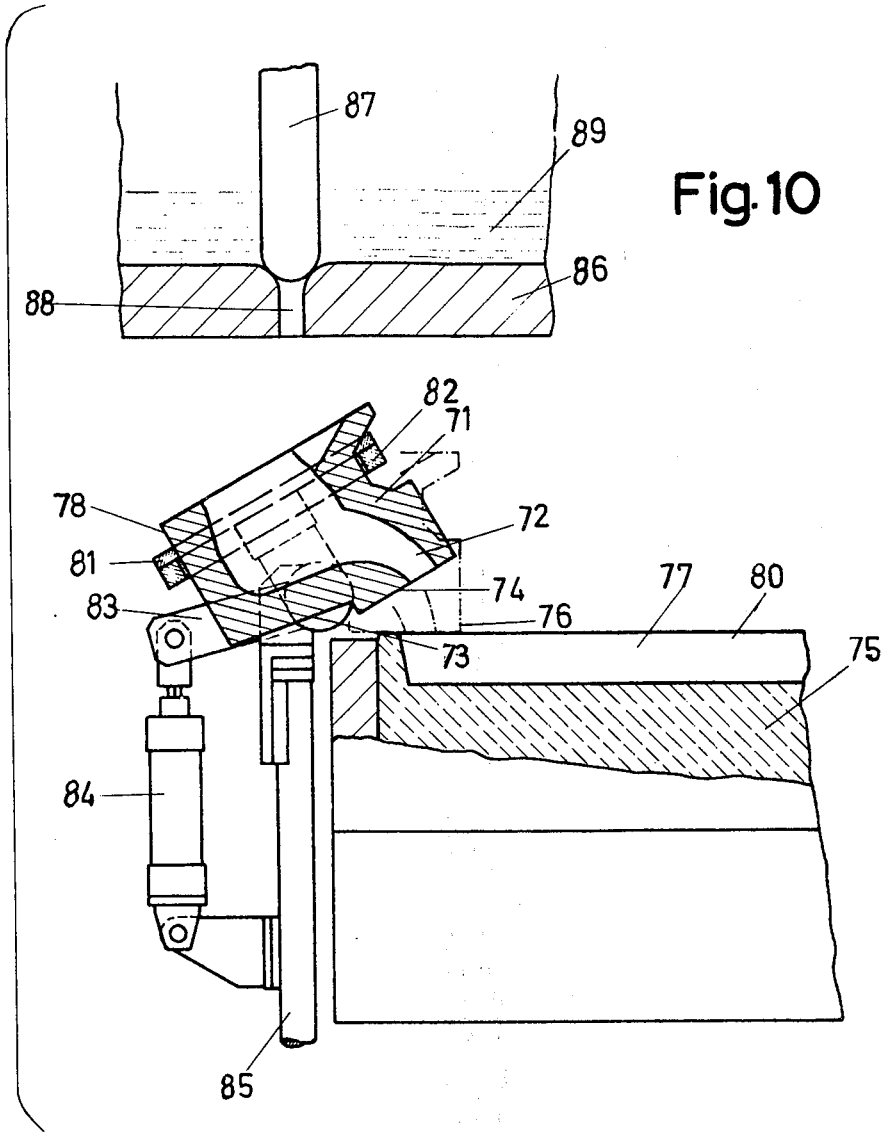
FIG. 10 is a vertical cross-sectional view of still another embodiment of the present invention.

In FIG. 10 a pouring device 71 is shown having walls which form a flowthrough member or casting basin with at least one melt outlet nozzle 72 located from the lowermost portion of the space within the casting basin. As can be seen from FIGS. 10 and 11, the pouring device 71 is movably displaceable both in the vertical and horizontal directions. The underside 73 of the device 71 is provided with a supporting surface 74 which, when the device is positioned on the top 80 of a mold 75, forms a cover plate for preventing splashing of the molten metal. The device is shown in full line tilted upwardly from the top of the mold 75. In addition, the device is shown by the dot-dash line 76 when it is positioned downwardly from the full line showing into contact with the top of the mold 75. As illustrated, the mold 75 has a basin 77 into which the outlet nozzle 72 deposits the melt.

For aligning the outlet nozzle 72 with the top 80 and the basin 77 of the mold 75, the device 71, as indicated above, is advantageously arranged to be moved or displaced in the vertical and horizontal directions. On the outer periphery 78 of the device 71, an annular bearing member 81 supports the pouring device 71 and, in turn, is supported by a holder 82 laterally enclosing the device 71. The holder 72 is connected to a tilting mechanism 83 which is driven by a pneumatically or hydraulically operated cylinder 84. The tilting mechanism 83 is spaced from the mold 75 and is supported by a separate supporting structure 85 located laterally of the mold. While the tilting mechanism is shown operating a single device 71, it is also possible to use the same mechanism for operating a plurality of such devices arranged adjacent to one another.

Positioned above the device 71 is a supply container 86 for molten metal 89 and it contains a stopper 87 displaceably positioned within an outlet 88 through which the molten metal flows into the flowthrough member or device 71. The nozzle 88 of the container 86 is arranged so that the molten metal 89 enters the mouth or inlet of the basin formed by the device both in the position where it contacts the top 80 of the mold 75 and in the position in which it is tilted upwardly from and out of contact with the mold.

Figure 11:
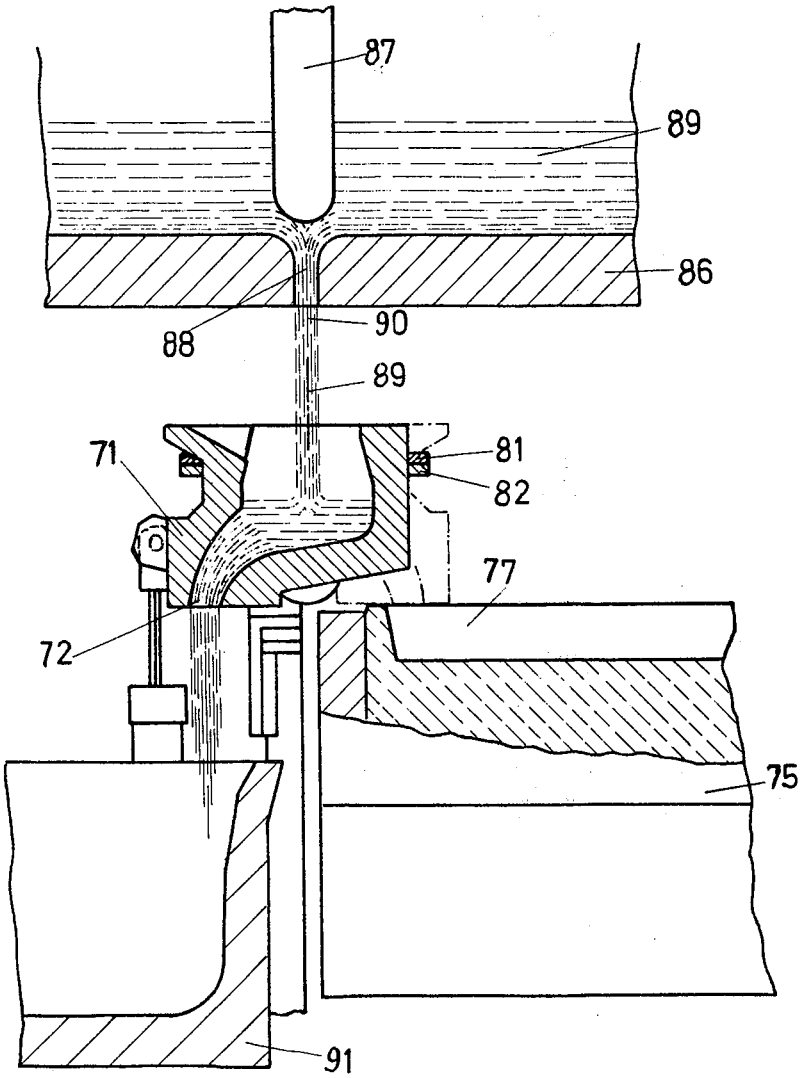
FIG. 11 is a vertical cross-sectional view of the device shown in FIG. 10 in a pouring position displaced from the mold.

In FIG. 11, the device 71 is shown displaced in the horizontal direction 180° about a vertical axis. In other words, while FIG. 10 indicates the ability of the pouring device or flowthrough member 1 to be tiltably displaced about a horizontal axis, FIG. 11 shows the ability of the mold to be moved or rotated about a vertical axis. The turning or rotation of the device 71 about the vertical axis can be carried out manually or mechanically in a manner which is not illustrated. The vertical axis 79 about which the device can be turned corresponds approximately to the central axis of the molten metal stream 90 from the outlet 88 and extends through the center of the basin within the device 71. In the illustrated position, the outlet nozzle 72 of the device 71 is located over a carry-back vessel 91 so that it is possible to return any melt remaining in the device which cannot be poured into the mold 75. Instead of a carry-back vessel 91 it is possible to provide a sand bed into which the molten metal 89 can be deposited from the flow-through member or device 71.

The combination of the inlet or open upper end of the device 71 along with the casting basin it forms and its outlet nozzle 72 provide a flowthrough passage for the melt, with the walls forming the passage providing a kinetic energy dissipating effect to the melt, since the stream of molten metal 90 flowing from the container 86 is slowed by the presence of the internal surface of the bottom wall of the basin with the outlet nozzle 72 being offset laterally from the inlet axis into the basin. As with the other embodiments described above, the outlet nozzle extends from the lowermost part of the basin, that is, the invert of the outlet nozzle at its inlet end is located at the lowermost surface of the bottom wall of the basin. Moreover, because during pouring the internal surface of the bottom wall is downwardly inclined and merges with the nozzle, and further, since the nozzle is downwardly inclined from the basin, the flow passage within the device 71 is automatically emptied of the melt.

The present invention is not limited to the form of the pouring device illustrated in the drawing. However, an important feature of the pouring device is the arrangement of the melt outlet from the basin directed downwardly and spaced laterally or offset from the central axis from the inlet into the basin.

The apparatus illustrated in FIGS. 10 and 11 operates in such a manner to afford the stepwise displacement of the molds. After each stepwise movement of the molds, the basin 77 in one of the molds 75 into which the molten metal is to be poured, is located below the outlet nozzle 72 of the device 71 which is tilted upwardly in the position shown in FIG. 10. By operating the tilting mechanism 83, the device 71 is pivoted downwardly so that its supporting surface 74 comes in contact with the top 80 of the mold 75. In this position, the pouring operation is carried out with the molten metal 89 flowing from a supply container 86 through the flowthrough member or device 71 into the mold 75. When the pouring operation has been completed, the tilting mechanism 73 is actuated and it displaces the pouring device 71 upwardly out of contact with the mold, so that the mold 75 can be moved one further step bringing another empty mold into position underneath the pouring device.

The advantages which can be achieved with the pouring device described above include particularly that, because the pouring device is adapted to be placed on the mold and owing to the containment thereby effected relative to the mold, the casting operation can be carried out without any harmful turbulence or splashing even with very large quantities poured per unit of time. Consequently, pouring can be improved, since the mold basin is filled more rapidly and the entrainment of slag is substantially obviated. A considerable reduction in operational disturbances is achieved by obviating metal splashes. Another advantage consists in improving the output of the apparatus as a result of increasing the quantity of melt which can be poured per unit of time. A further advantage is that the tilting of the pouring device avoids the subsequent dripping of metal from the device when the pouring operation has been completed, and subsequent dripping of liquid metal from the supply container through the pouring device onto the mold in the period of time between the pouring operations.

While specific embodiments of the invention have been shown and described in detail to illustrate the application of the inventive principles, it will be understood that the invention may be embodied otherwise without departing from such principles.

What is claimed is:

1. A device for pouring a molten metal from a supply source into a mold comprising wall means forming a flowthrough member for receiving molten metal from the supply source and for flowing the molten metal into the mold, said wall means arranged to provide automatic emptying of the molten metal into the mold and defining kinetic energy dissipating means to provide a kinetic energy dissipating effect to the melt passing through the flowthrough member, said wall means forming an upwardly extending basin having a melt inlet at its upper end and a melt outlet at its lower end, and defining a nonlinear flowthrough path extending in a configuration which is continuously sloped in the flow direction from said inlet to said outlet, said melt outlet being offset laterally from said melt inlet and extending from the lowermost point of the basin with said kinetic energy dissipating means being located within said flowthrough member between said melt inlet and said melt outlet, and support means independent of the mold movably supporting said flowthrough member for displacing it between a first position supported on top of the mold and a second position spaced above the top of the mold, said support means being arranged to tilt said basin between the first and second position about a horizontal axis.

2. A device according to claim 1 wherein said support means includes a support device for said flowthrough member arranged for rotatably displacing said member about a vertical axis.

3. Device for pouring molten metal, as set forth in claim 2, wherein said support device comprises an annular bearing member having an upwardly extending central axis supporting the outer periphery of said casting basin at a location intermediate its upper and lower ends, and an annular holder having an upwardly directed central axis positioned below and slidably supporting said annular bearing member, said support means include a support structure for said flowthrough member spaced from the mold, said support structure located below said flowthrough member, and a tilting device connected to said annular holder for pivoting said flowthrough member about a horizontal axis and moving it between its first and second positions.

4. A device according to claim 1 wherein said support means are arranged to tilt a plurality of said flowthrough members.

5. A device according to claim 1 wherein said wall means comprises a bottom wall and side walls extending vertically upwardly from said bottom wall and combining to form a vertically extending basin open at its top for forming an inlet opening to which the molten metal is supplied into the basin from the supply source, the basin is closed laterally and at its bottom with a tubularly-shaped laterally enclosed outlet passage located at the bottom of said basin and with the end of said outlet passage communicating with said basin located in the lower end of said sidewalls and spaced laterally from the central axis from the inlet opening in the upper end of said basin, said bottom of said basin sloping continuously downwardly to the end of the outlet passage connected to said basin and with the invert of the end of the outlet passage located at the lowermost point in the bottom of said basin, and said outlet passage having an oppositely arranged end spaced outwardly from the basin with said outlet passage sloping downwardly to its end spaced outwardly from said basin.

6. Device for pouring molten metal, as set forth in claim 5, wherein the axis of said outlet passage at its end communicating with the basin in said flowthrough member is substantially horizontal and the axis of the opposite end of the outlet passage is substantially vertical.

7. Device for pouring molten metal, as set forth in claim 5, wherein the inlet opening into the basin in said flowthrough member at its upper end has a smaller cross-section than said basin spaced below the inlet opening.

8. Device for pouring molten metal, as set forth in claim 5, wherein the bottom surface of said chamber pitches downwardly with the lowermost point of the bottom surface being located adjacent the end of said outlet passage communicating with the basin.

9. Device for pouring molten metal, as set forth in claim 5, wherein a pair of angularly spaced said outlet passages communicate with and extend outwardly from the basin in said flowthrough member.

10. Device for pouring molten metal, as set forth in claim 9, wherein a ridge is formed in the bottom surface of the basin within said flowthrough member located between the projection of the axes of the pair of said outlet passages and said ridge bisecting the angle formed between the axes of said outlet passages, and said ridge located in a horizontal plane above the ends of said outlet passages communicating with the basin so that the bottom surface of said chamber slopes downwardly from said ridge to the ends of said outlet passages communicating with the basin.

* * * * *

UNITED STATES PATENT OFFICE

CERTIFICATE OF CORRECTION

Patent No. 3997088 Dated December 14, 1976

Inventor(s) Erwin Bührer

It is certified that error appears in the above-identified patent and that said Letters Patent are hereby corrected as shown below:

In the heading of the Patent [30] should read as follows:

--[30] Foreign Application Priority Data

Apr.21, 1971 Switzerland.....5827/71
Aug.17, 1971 Switzerland.....12'047/71--.

Signed and Sealed this

First Day of March 1977

[SEAL]

*Attest:*

RUTH C. MASON
*Attesting Officer*

C. MARSHALL DANN
*Commissioner of Patents and Trademarks*